US007695543B2

(12) United States Patent
Martorana et al.

(10) Patent No.: US 7,695,543 B2
(45) Date of Patent: Apr. 13, 2010

(54) PROCESS FOR THE PRODUCTION OF SILVER FILAMENTS HAVING MICROMETRIC OR SUB-MICROMETRIC DIAMETER AND PRODUCT THEREOF

(75) Inventors: Brunetto Martorana, Orbassano (IT); Luigi Nicolais, Orbassano (IT); Gianfranco Carotenuto, Orbassano (IT); Piero Perlo, Orbassano (IT)

(73) Assignee: C.R.F. Societa Consortile per Azioni, Orbassano (Turin) (IT)

( * ) Notice: Subject to any disclaimer, the term of this patent is extended or adjusted under 35 U.S.C. 154(b) by 353 days.

(21) Appl. No.: 11/370,181

(22) Filed: Mar. 8, 2006

(65) Prior Publication Data

US 2006/0260720 A1 Nov. 23, 2006

(30) Foreign Application Priority Data

Mar. 11, 2005 (EP) ..... 05425149

(51) Int. Cl.
*B22F 9/20* (2006.01)
*B22F 1/00* (2006.01)

(52) U.S. Cl. ..... 75/362; 148/430

(58) Field of Classification Search ..... 75/362; 148/430

See application file for complete search history.

(56) References Cited

U.S. PATENT DOCUMENTS

2002/0001977 A1 1/2002 Gole et al.

OTHER PUBLICATIONS

G. Carotenuto et al. A universal method for the synthesis of metal and metal sulfide clusters embedded in polymer matrices, J. Mater. Chem., 2003, vol. 13, p. 2927-2930.*

G. Viau et al, Formation of assembled silver nanowires by reduction of silver thiolate in polyol/toluene medium, Chem. Commun. 2003, p. 2216-22.17.*

H. Goldschmidt and C. Vautin, Aluminium as a heating and reducing agent, The Journal of the Society of Chemical Industry, 1898, vol. 6, Issue 17, p. 543-545.*

Hu et al, "Template preparation of high-density, and large area AG nanowire array by acetaldehyde reduction", Materials Science & Engineering, A: Structural Materials: Properties, Microstructure And Processing, A371(1-2), pp. 236-240, 2004.

Hu et al, "A simple and effective route for the synthesis of crystalline silver nanorods and nanowires", Advanced Functional Materials, 14(2), pp. 183-189, 2004.

Xiong et al, "Formation of silver nanowires through a sandwiched reduction process", Advanced Materials (Weinheim, Germany), 15(5), pp. 405-408, 2003.

* cited by examiner

*Primary Examiner*—George Wyszomierski
*Assistant Examiner*—Mark L Shevin
(74) *Attorney, Agent, or Firm*—Nixon & Vanderhye, P.C.

(57) ABSTRACT

The present invention relates to a process for the production of continuous silver wires having micrometric or sub-micrometric diameter comprising a step of thermal decomposition of silver dodecyl-mercaptide in the presence of metallic aluminum.

20 Claims, 4 Drawing Sheets

(a)

(b)

(a)

(b)

PROCESS FOR THE PRODUCTION OF SILVER FILAMENTS HAVING MICROMETRIC OR SUB-MICROMETRIC DIAMETER AND PRODUCT THEREOF

The present invention relates to a process for the preparation of silver wires with a micrometric or sub-micrometric diameter (normally referred to as filaments), in particular continuous silver wires, and the corresponding product.

The availability of methods for the quantitative preparation of micrometric and sub-micrometric wires made of metal conductor of low resistivity (e.g., Ag, Au, Cu) is of primary importance in the sector of micro- and nano-technologies.

The constant quest for ever-increasing miniaturization of electronic, electro-mechanical, hydraulic apparatus, etc. requires an equally ever-increasing availability of materials of this type. Wires of micrometric and sub-micrometric diameter made of a good electrical conductor are, for example, required for the construction of microelectrodes, miniaturized thermocouples, microcoils, micro-antennas, as weld material for the execution of microwelds, vascular stands, etc.

Whilst a large number of synthetic approaches is currently available in the literature for the preparation of powders of pure metals or alloys, having various dimensions (nanometric, sub-micrometric and micrometric), compositions (binary and ternary alloys, core-shell structures, etc.) and regular geometries of various types (polyhedra, spheres, cubes, etc.), the number of the techniques of preparation that enable microscopic metallic objects with significant anisotropy of shape (high length/thickness ratio) to be obtained is, instead, still extremely limited.

The techniques developed for the preparation of anisotropic metallic structures by means of chemical processes in solution are principally based upon the use of a solid matrix that functions as template for the structure that it is intended to generate. This is typically constituted by porous alumina membranes [1], meso-porous silica ($SiO_2$) [2, 3], and carbon nanotubes [4]. The synthesis of metallic nanostructures in tubular micelles [5] and the use of photo-reduction techniques [6] have also been investigated, but in all cases with results that are far from satisfactory.

Also the uniaxial alignment of silver or gold spherical particles on the surface of a matrix of graphite [7] or of alumina [8] has been explored.

Finally, described in the literature [9] is the possibility of bringing about spontaneous organization of silver particles in regular planar structures of a pure filiform type, and in this case it is the anisotropy of the individual particles that produces their unidirectional assemblage.

In addition to these techniques of chemical synthesis in solution, also some reactions in solid phase have been studied [10-12]. These synthetic schemes are in general based upon the use of silver or gold salts (Au(I)) of long-hydrocarbide-chain carboxylic acids (i.e.: $CH_3$—$(CH_2)_n$—COOAg, with n>10) or of compounds of these two metals with long-hydrocarbide-chain primary amines. In this process, thermal treatment at moderately high temperatures or mild exposure to ultraviolet radiation can determine separation of a metallic phase with high anisotropy of shape. However, the quality of the filiform structures so far produced using these techniques is always very poor, principally owing to their poor regularity.

The pyrolysis of metallic mercaptides is a well-known reaction in organic chemistry for the preparation of thioethers (RSR) and disulphides (RSSR) [13]. This type of process has also been used for the deposition of films made of gold (and Au/Ag alloys) or of films of semiconductors (metallic sulphides) on ceramic substrates [14] and is currently under study for the synthesis of nanoparticles of metallic sulphide of various geometries (a technique of synthesis referred to as "solventless") [15]. The thermal decomposition of the metallic mercaptides has also been used for the preparation of metallo-polymer nanocomposites [16].

The purpose of the present invention is to provide a solution that is able to overcome the drawbacks encountered up to now in the production of continuous metallic-silver filaments.

According to the present invention said purpose is achieved thanks to a process having the characteristics referred to specifically in the ensuing claims. The invention also relates to the corresponding product.

The annexed claims form an integral part of the technical teaching provided herein in relation to the invention.

The process according to the present invention substantially envisages the thermal decomposition of silver dodecyl-mercaptide in the presence of metallic aluminium and is able to provide continuous metallic-silver filaments with a length of several hundreds of micron and a diameter of a few micron.

In particular, the present invention is able to provide continuous metallic-silver filaments with a length of several hundreds of micron, a uniform diameter of a few micron and substantially without any defects.

The invention will now be described, purely by way of non-limiting example, with reference to the annexed figures, in which.

Figure 1:
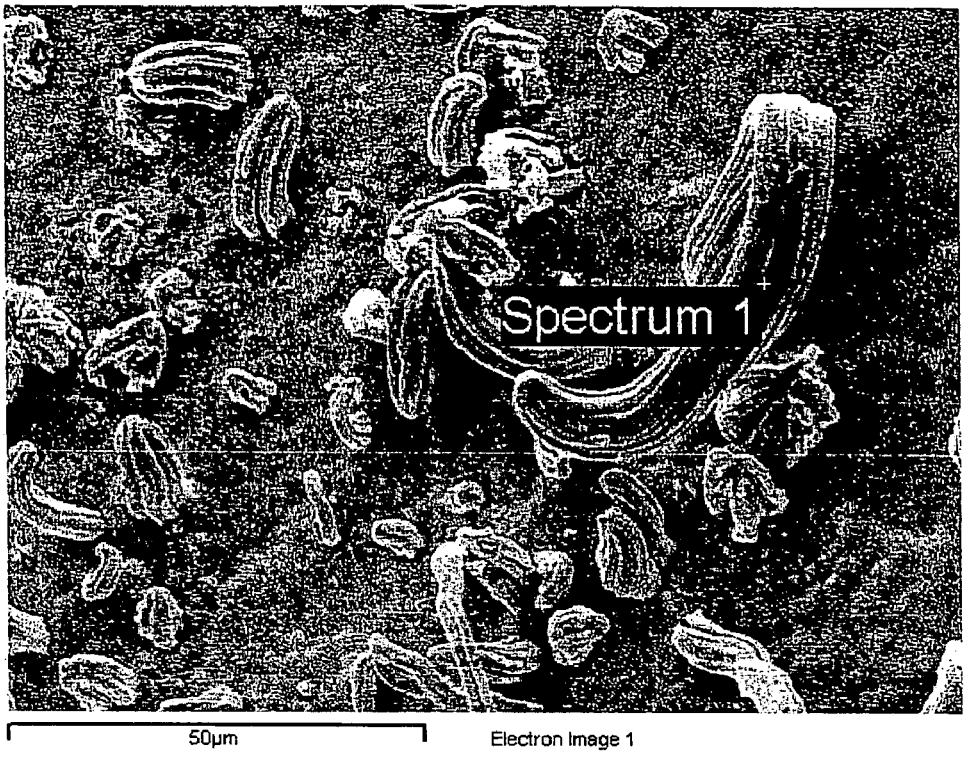
FIG. 1 represents scanning-electron-microscope (SEM) micrographs illustrating the microstructure of two specimens of silver dodecyl-mercaptide subjected to pyrolysis of different duration: (a) 5 min at 200° C.; (b) 20 min at 200° C.
Figure 1:
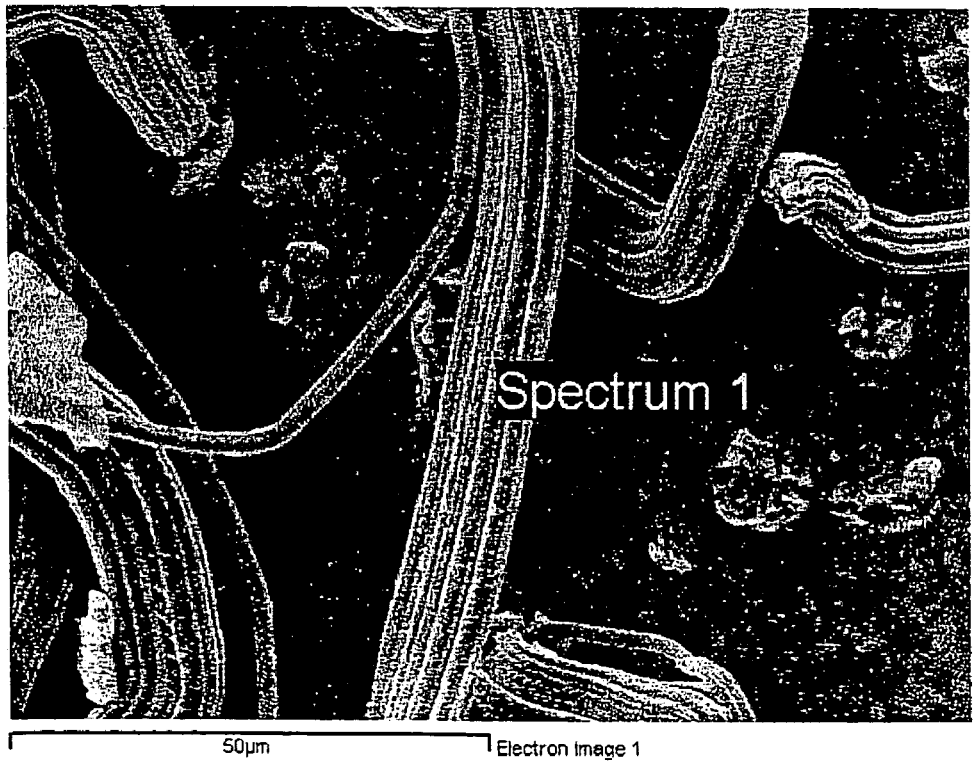

Continuous metallic-silver filaments are obtained by thermal decomposition of silver dodecyl-mercaptide ($AgSC_{12}H_{25}$) compressed in a capsule of metallic aluminium. In particular, the mercaptide is decomposed at a temperature of approximately 200° C., producing a continuous matrix of silver sulphide ($Ag_2S$) and elementary silver in the form of continuous fibres.

Without wishing to be tied down to any theory in this regard, the present applicant has reason to believe that the formation of said filaments starts with the generation of bundles of contiguous fibres that develop progressively from the matrix until they separate, in a more or less complete manner, into the individual filamentous components. This is probably due to the mechanical stresses produced within the bundle during its growth.

The fibres all have the same diameter of between approximately 0.1 and 30 μm, generally approximately 2.5 μm, and have a length of several hundreds of micron. They are without defects, have a low surface roughness and do not appear hollow.

Without wishing to be tied down to any theory in this regard, the present applicant has reason to believe that the formation of these filaments results from the templating effect performed by the tubular structures (columnar liquid-crystalline phase), in which the silver mercaptide is organized at the moment of its decomposition. Indispensable, however, is the presence of metallic aluminium for carrying out this process.

The technique described herein enables silver filaments of excellent quality to be obtained. In particular, when the thermal decomposition of the mercaptide is conducted within an aluminium capsule, the filaments are not hollow but full, have a perfectly circular cross section and are without any type of morphological defect (pinching, pores, cracks, variations in cross section, etc.). Furthermore, they are characterized by an extremely low surface roughness and have all the same diameter.

Consequently, the proposed approach distinguishes itself clearly from the ones so far developed in as much as it enables real metallic fibres to be obtained that are usable for a wide range of applications.

Chemical Synthesis of Silver Mercaptide

The metallic-silver filaments were obtained by pyrolysis of silver dodecyl-mercaptide.

Mercaptides are not in general commercially available chemical products; however, their preparation is quite simple and based upon common chemical reagents.

The silver dodecyl-mercaptide used in the framework of the present invention was obtained by treating silver nitrate ($AgNO_3$, Aldrich) with dodecantiol ($C_{12}H_{25}SH$, Aldrich). In particular, to a solution of silver nitrate in acetonitrile ($CH_3CN$) there was added drop by drop using a burette a solution of dodecantiol in acetone.

The reagents were used in exactly stoichiometric amounts to prevent oxidation of the possible excess thiol by the nitrate ions present in the system. Other salts of silver (e.g., carbonate, acetate, etc.) are not usable on account of their low solubility in polar organic solvents of any nature.

Acetonitrile enables rapid dissolution of large amounts of silver nitrate whilst the presence of acetone favours the separation of the (apolar) mercaptide. The reaction was conducted at room temperature and under vigorous magnetic stirring.

The mercaptide is separated in the form of a white or pale-yellow powder according to the conditions in which the synthesis is conducted (e.g., the rapidity with which the thiol is added, the rate of stirring, etc.).

The product is readily separable by filtration when it is left to re-crystallize for some hours at room temperature.

The addition of further amounts of acetone (or ethyl alcohol) also favours separation in so far as the polarity of the liquid phase increases.

The product was pump-filtered (45-μm paper filters) and then washed carefully on the filter with abundant acetone. The product was finally left to dry in air.

The reaction yields are very high (96%), and the product in the dry state is absolutely air- and light-stable even for long periods.

Pyrolysis of Mercaptide

Thermal decomposition of silver dodecyl-mercaptide was conducted in a well-controlled manner by resorting to the use of an instrument for the measurement of the melting point (Melting-Point Büchi, Mod. B-545).

Some tens of milligrams of mercaptide powder (typically, 70-80 mg) were placed within glass tubes of the type used for determination of the boiling point of liquids (internal diameter: 2 mm), the internal surface of which had been coated with metallic aluminium using a film of rolled aluminium.

Pyrolysis is conducted in general by applying a linear heating ramp of 10° C./min, in the thermal range 25° C.-300° C. In the course of the thermal treatment the mercaptide powder did not come into contact with air in so far as the film of rolled aluminium was closed at its ends, whereas the external glass tube was left open.

During heating there occurs: (i) mesophasic transition of the mercaptide (passage from the crystalline phase of a lamellar type to the columnar one) at a temperature of 130° C.; (ii) melting of the mercaptide (transition from the columnar crystalline mesophase to that of amorphous liquid) at the temperature of 200° C.; (iii) decomposition thereof, with formation of a yellow-orange metallic-silver nanometric phase (for plasmonic absorption of the silver at a wavelength of 430 nm), gradually evolving towards pure black, which also occurs at around 200° C.; and (iv) evaporation of sulphurated organic by-products at approximately 300° C. (in particular, the vapours produced do not leave the system, but flow back into the tube).

For recovery of the product, the aluminium tube was slid out of the external glass tube, carefully opened and placed in acetone.

The system was put for some minutes in a sonicator bath, and the suspension in acetone was recovered.

The best results (namely, completely separate silver fibres) were, however, obtained by placing the powder of silver mercaptide well pressed in an aluminium capsule for a differential scanning calorimeter (DSC—of the type for solid specimens, diameter: 5 mm), subsequently sealed by applying a slight pressure using the purposely provided device (DSC press), and carrying out the thermal treatment within the DSC device. In particular, the thermal treatment was conducted by applying a linear heating ramp of 10° C./min, in the thermal range 25° C.-300° C. The calorimeter was kept in an atmosphere of nitrogen flow.

It should, however, be noted that a similar treatment conducted in conditions of controlled temperature by means of a muffle furnace or a tubular oven leads to similar results. To guarantee the integrity of the aluminium capsule in the course of the thermal treatment, also in this case the use of inert atmosphere (nitrogen or argon) would be preferred.

For execution of the SEM micrographs some drops of the suspension in acetone were set on a specimen-holder made of aluminium for SEM microscopy and left to dry. The specimens were metallized with gold to improve the quality of the images.

All the transitions observed in the process of thermal decomposition of the mercaptide were characterized by an appreciable heat tonality and consequently were clearly visible in the calorimetric analysis with DSC, described in what follows.

Morphological and Elementary Analysis of the Material Produced by Pyrolysis, and Calorimetric (DSC) and Thermogravimetric (TGA) Study of the Process of Pyrolysis The morphology of metallic-silver wires is perfectly visualizable with the aid of a scanning electron microscope (SEM, Cambridge S360).

The microstructure of the wires is illustrated in FIG. 1. As may be seen, the filaments are grouped into bundles (8 filaments per bundle) and are more or less completely separated according to their degree of development.

The filaments have the same diameter of approximately 2.5 μm and a length of several hundreds of micron. Their surface is everywhere smooth and characterized by a low surface porosity and/or surface roughness.

The wires have throughout their development a uniform diameter (i.e., they are gauged) and are practically without defects of any kind (pinchings, fractures, cracks, pores, etc.).

From an observation of the ends of the wires they appear as full and consequently should be classified not as metallic nanotubes, but as "nanowires" (nanofilaments).

The filiform metallic structures present in specimens of silver mercaptide subjected to treatments of pyrolysis of different duration show a different degree of development.

Initially, the fibres are present only in the form of short bundles, in which, however, the constituent fibres are readily distinguishable. In said type of specimens there are rarely present individual fibres in the matrix. The identity of the individual fibres is lost in the tapered end of the bundle of fibres.

Protraction of the treatments of pyrolysis determines a progressive development of the bundles of fibres and involves deformation thereof. The deformation of the bundle progresses up to the point of causing detachment of the individual fibres and their subsequent deformation. This is probably due to mechanical stresses generated in the structure on account of the non-uniform distribution of the stresses on the various elements.

Figure 2:
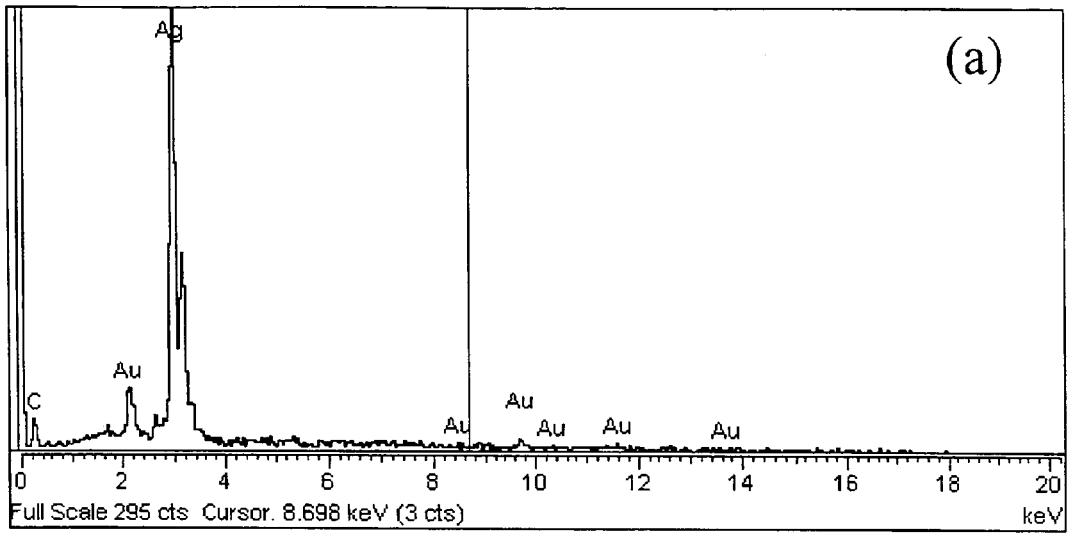
FIG. 2 represents energy dispersive spectra (EDS) obtained on two different points of the specimen of dodecyl-mercaptide of silver anylate illustrated in FIG. 1: (a) surface of one of the fibres; (b) continuous matrix englobing the fibres.
Figure 2:
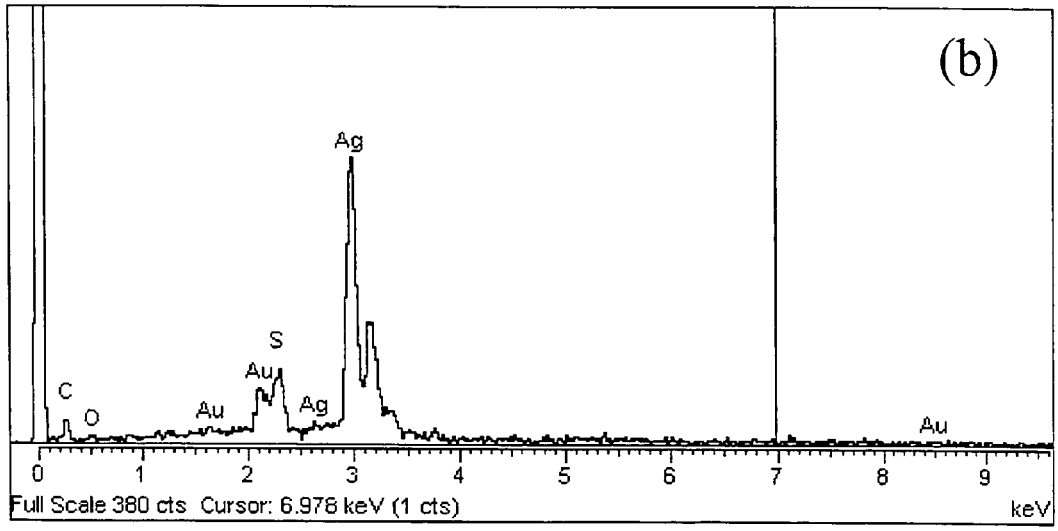

The identification of the phases produced by the process of pyrolysis (elementary analysis) is conducted with the aid of the x-ray microprobe (EDS, LINK AN10000) with which the scanning electron microscope is equipped (see FIG. 2).

In particular, as illustrated in FIG. 2*a*, the wires consist exclusively of metallic silver (total absence of the signal of sulphur). Furthermore, in the region explored, also the signal of other elements is only of an extremely small degree in comparison with that of silver (oxygen is absent and there are only small traces of carbon). The filaments develop within a morphologically heterogeneous continuous phase.

The elementary analysis conducted via EDS analysis on this phase shows that it is constituted by silver sulphide (see FIG. 2*b*): in fact, in this case the spectrum includes, in addition to the signal of silver, also the signal of sulphur of comparable intensity (the ratio between the signals of the two elements does not correspond exactly to the stoichiometric one Ag:S=2:1 in so far as the sensitivity of the instrument for the individual elements is different). Other elements (oxygen and carbon) are present only in traces. In practice, the wires produced by the process of pyrolysis are substantially constituted by elementary silver, which has developed within a continuous matrix of $Ag_2S$.

Figure 3:
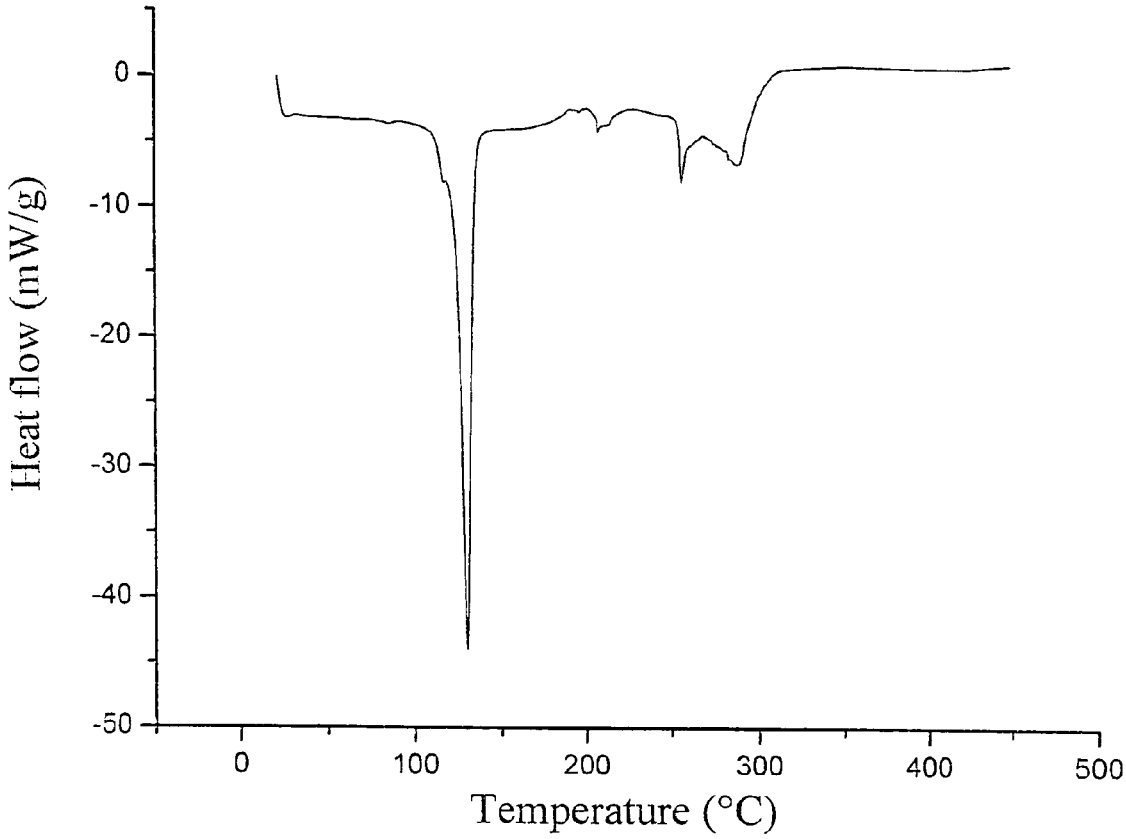
FIG. 3 represents a differential-scanning-calorimetry (DSC) thermogram of a specimen of silver dodecyl-mercaptide (from 0° C. to 450° C. at 10° C./min, in nitrogen flow)
Figure 4:
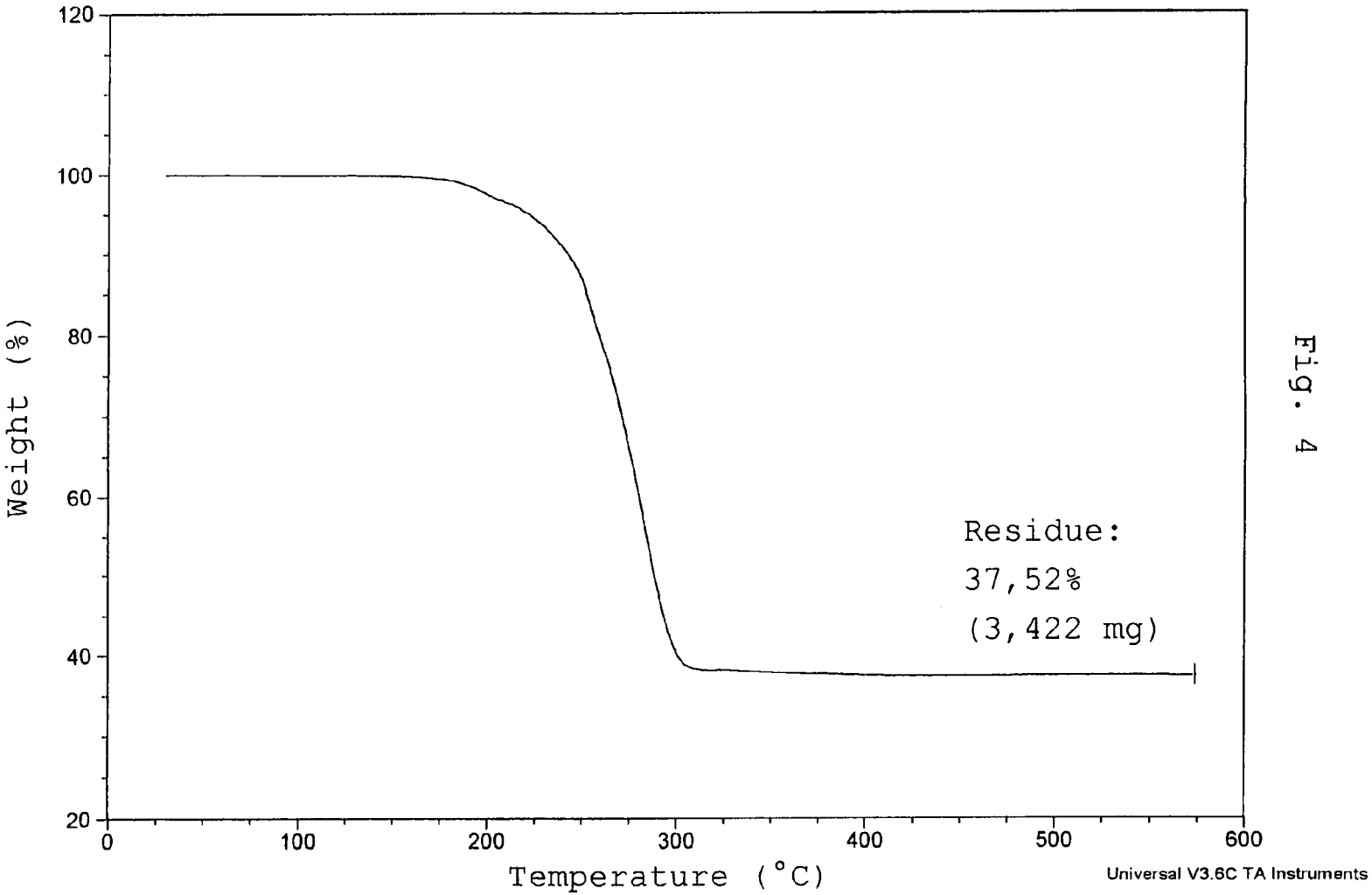
FIG. 4 represents a thermogravimetric-analysis (TGA) thermogram of a specimen of silver dodecyl-mercaptide (from 30° C. to 600° C. at 10° C./min, in nitrogen flow).

The thermodynamic transitions involved in the formation of metallic wires can be identified by means of calorimetric analysis conducted with a differential-scanning calorimeter (DSC, TA-Instrument Mod. Q100). As shown by the DSC thermogram illustrated in FIG. 3, important information (e.g., number and type) on the phenomena involved in the process of pyrolysis of silver mercaptide can be obtained thanks to their heat tonality.

The thermogram is obtained by heating a specimen of $AgSC_{12}H_{25}$ from 0° C. to 450° C. at the rate of 10° C./min in nitrogen flow, and the specimen is placed in a sealed aluminium capsule. The endothermic transitions visible in the thermogram are interpretable on the basis of the following physical processes involved: transition from the crystalline structure of a lamellar type to the crystalline one of a columnar type, transition from the columnar crystalline structure to the amorphous liquid phase (practically, melting of the material), and evaporation of the liquid phase produced by the reaction of decomposition.

The thermal decomposition of the compound should start at a temperature slightly lower than that of melting of the compound and then proceed progressively faster as the temperature increases. In accordance with what is described in the literature [17, 8], the first transition produces the intense endothermic peak visible at approximately 130° C., whilst the second transition is a cause of the peak just visible at 180° C. In accordance with the characteristic yellow-orange colouring, which the liquid phase just produced assumes, the process of decomposition of the mercaptide and that of melting thereof should be almost concomitant, and it is probably for this reason that the form of the signal at DSC corresponding to the melting of the mercaptide is quite uncertain.

In particular, if the process of thermal decomposition of the mercaptide is exothermic, the signal in the 160-230° C. range could be interpreted in terms of an initial development of heat linked to the exothermicity of the decomposition, immediately contrasted and overcome by the significant endothermicity of melting of the mercaptide that has not yet decomposed. The further decomposition of the mercaptide to sulphide would then proceed in the molten mass.

The further two endothermic peaks visible in the DSC thermogram at higher temperatures (280° C. and 300° C.) should be attributed to the evaporation of organic by-products generated in the course of degradation (probably dodecyl-thioether and dodecyl-disulphide).

Thermogravimetric analysis (TGA, TA-Instrument Mod. Q500) of silver dodecyl-mercaptide, conducted by placing the powder in an open aluminium capsule and set on top of the specimen-holder (platinum rack) of the TGA, shows a single loss of weight for the compound at a temperature of 300° C. In accordance with the visual analysis conducted on the specimen in the course of its thermal degradation and of the calorimetric characterization at DSC, said signal is produced by the process of evaporation of the organic by-products generated in the course of pyrolysis.

In particular, the residual weight encountered experimentally (37%) is slightly lower than the value envisaged theoretically for the formation of silver sulphide (approximately 40%). This is in accordance with the presence of metallic silver in the matrix of $Ag_2S$.

Mechanism of Formation of the Silver Filaments

Without wishing to be tied down to any specific theory in this connection, the present applicant has reason to believe that the formation of the continuous metallic-silver fibres in the course of the process of thermal degradation of silver dodecyl-mercaptide may be interpreted in the light of mechanisms already at times formulated for interpreting the formation of metallic phases with anisotropy of shape in the course of the thermal degradation of long-hydrocarbide-chain silver carboxylates.

In general, the hypothesis of the mechanism is based upon the liquid-crystalline-phase transitions proper to these particular compounds [17]. In particular, silver normal-alkanthiolates ($AgSC_nH_{2n+1}$) at room temperature have a lamellar structure, in which each atom of sulphur is located so that it forms a bridge between three silver atoms [18]. It is, however, well known in the literature that these solids have a behaviour of thermotropic liquid crystals, and consequently these lamellar crystals are transformed at higher temperatures into new metastable phases. The number of phases and temperatures of transition involved are in strict relation with the number of carbon atoms in the normal alkyl chain (n). In the particular case of silver dodecyl-mercaptide (n=12), it is known that this compound undergoes a phase transition at the temperature of 130° C. passing from the lamellar morphology to a columnar hexagonal morphology. In this new phase, the thiolate groups ($RS^-$) are located so that they form a bridge between two silver atoms for forming octameric rings (i.e., rings with eight silver atoms). Said discoidal structures are then stacked so as to form a sort of hollow column [17], the internal diameter of which is of just a few nanometers.

Even though the entire process is not yet completely understood, it may be hypothesized that, when at higher temperatures the mercaptide molecules involved in such a type of supra-molecular organization are decomposed to produce metallic atoms, the latter diffuse within the columnar cavities, accumulating therein until they form filiform metallic structures (nanowires).

Consequently, if the thermal decomposition of the mercaptide starts at temperatures lower than those of disgregation of the columnar structures (melting point of the mercaptide), these can perform the function of template for the development of the metallic phase in fibrous morphology. Obviously, the nanometric cross section of the columnar structures would produce nano-fibrous elements, from the subsequent association of which the wires of micrometric diameter observed experimentally would be produced.

It should be noted how the further organization in bundles of said wires could be explained on the basis of the theories of self-similarity frequently observed for mesoscopic systems.

The role of aluminium in the process, the presence of which is indispensable for the purposes of the formation of the elementary silver phase, should also be interpreted.

The elementary aluminium could simply perform the function of reducing agent for the nobler metal (silver) so as to generate an amount of silver sufficient for the constitution of the continuous wires.

In conclusion, the pyrolysis of silver dodecyl-mercaptide compressed in an aluminium capsule at the temperature of approximately 200° C., constitutes a simple technique, but one that is effective for the preparation of continuous metallic-silver wires without defects and with excellent morphological and structural characteristics (low surface roughness, monodispersed diameter, etc.). These morphological characteristics of the material are such as to enable certainly its use in a wide range of technological sectors (e.g., micromechanical, electronic, etc.). The formation of these filiform structures could be put down to the templating effect produced by the tubular structures of the columnar liquid-crystalline phase in which the mercaptide is organized at the moment of its decomposition.

REFERENCES

1. X. Y. Zhang, L. D. Zhang, Y. Lei, L. X. Zhao and Y. Q. Mao, *J. Mater. Chem.,* 2001, 11, 1732
2. M. H. Huang, A. Choudrey and P. Yang, *Chem. Commun.,* 2000, 1063
3. J-Y. Piquemal, G. Viau, P. Beaunier, F. Bozon-Verduraz and F. Fiévet, *Mater. Res. Bull.,* 2003, 2172, 389
4. S. Fullam, D. Cotell, H. Rensmo and D. Fitzmaurice, *Adv. Mater.,* 2000, 12, 1430
5. N. R. Jana, L. Gearheart and C. J. Murphy, *Chem. Commun.,* 2001, 617
6. Y. Zhou, S. H. Yu, C. Y. Wang, X. G. Li, Y. R. Zhu and Z. Y. Chen, *Adv. Mater.,* 1999, 11, 850
7. T. O. Hutchinson, Y-P. Liu, C. Kiely, C. J. Kiely and M. Brust, *Adv. Mater.,* 2001, 13, 1800
8. E. Fort, C. Ricolleau and J. Sau-Pueyo, *Nano Lett.,* 2003, 3, 65
9. B. A. Korgel and D. Fitzmaurice, *Adv. Mater.,* 1998, 10, 661
10. S. Gomez, K. Philippot, V. Collière, B. Chaudret, F. Senocq and P. Lecante, *Chem. Commun.,* 2000, 1945
11. S. J. Lee, S. W. Han and K. Kim, *Chem. Commun.,* 2002, 442
12. K. Abe, T. Hanada, Y. Yoshida, N. Tanigaki, H. Takiguchi, H. Nagasawa, M. Nakamoto, T. Yamaguchi and K. Yase, *Thin Solid Films,* 1998, 327, 524
13. H. Gilman, Chimica Organica Superiore, Edizioni Scientifiche Einaudi, 1956, Vol. II, p. 951
14. U.S. Pat. No. 6,231,925 (May 15th, 2001) Davlin; U.S. Pat. No. 2,994,614 (Aug. 1st, 1961) Howard et al.; U.S. Pat. No. 5,707,436 (Jan. 13th, 1998) Fritsche et al.; U.S. Pat. No. 2,984,575 (May 16th, 1961) Howard et al.; U.S. Pat. No. 2,490,399 (Dec. 6th, 1949) Kermit et al.
15. M. B. Sigman, A. Ghezelbash, T. Hanrath, A. E. Saunders, F. Lee, B. A. Korgel, *J. Am. Chem. Soc.* 125 (2003) 16050-16057; T. H. Larsen, M. Sigman, A. Ghezelbash, R. C. Doty, B. A. Korgel, *J. Am. Chem. Soc.* 125 (2003) 5638-5639
16. G. Carotenuto, B. Martorana, P. Perlo, L. Nicolais, *J. Mater. Chem.* 13 (2003) 2927
17. G. Viau, J. Y. Piquemal, M. Esparrica, D. Ung, N. Chakroune, F. Warmont, F. Fiévet, *Chem. Commun.* 2003, 2216-2217
18. I. G. Dance, K. J. Fisher, R. M. Herath, Banda, M. L. Scudder, *Inorg. Chem.* 114 (1992) 4182

The invention claimed is:

1. A process for the production of silver wires having a micrometric or sub-micrometric diameter comprising the steps of:

i) providing silver dodecyl-mercaptide;

ii) providing metallic aluminium; and iii) subjecting to heating said silver dodecyl-mercaptide in the presence of said metallic aluminium, said heating determining the decomposition of said silver dodecyl-mercaptide into elementary silver in the form of wire and wherein said silver dodecyl-mercaptide is provided in the form of compressed powder and said metallic aluminium is provided in the form of a capsule, and wherein the wire thus produced is silver wire having a micrometric or sub-micrometric diameter.

2. The process according to claim 1, wherein said heating step is a step of pyrolysis.

3. The process according to claim 1, wherein said heating step is conducted at a temperature of between approximately 150° C. and 300° C.

4. The process according to claim 3, wherein said heating step is conducted at a temperature of between approximately 200° C. and 250° C.

5. The process according to claim 4, wherein said heating step is conducted at a temperature of approximately 200° C.

6. The process according to claim 1, wherein said heating step is conducted for a period of time of between approximately 1 and approximately 20 minutes.

7. The process according to claim 6, wherein said hearing step is conducted for a period of time of between approximately 5 and approximately 10 minutes.

8. The process according to claim 1, wherein said silver dodecylmercaptide is set in direct contact with said metallic aluminium.

9. The process according to claim 1 wherein said aluminium capsule contains within it said silver dodecyl-mercaptide in powder in pressed form.

10. The process according to claim 1, wherein said aluminium capsule is closed.

11. A process for making silver wires having micrometric or sub-micrometric diameters comprising:

using silver dodecyl-mercaptide in the form of compressed powder, using metallic aluminum in the form of a capsule, heating the silver dodecyl-mercaptide in compressed powder form in the presence of the metallic aluminum in capsule form, and whereby the heating of the silver dodecyl-mercaptide in compressed powder form in the presence of the metallic aluminum in capsule form results in decomposition of the silver dodecyl-mercaptide into silver wire having a micrometric or sub-micrometric diameter.

12. The process according to claim 11, wherein said heating step is a step of pyrolysis.

13. The process according to claim 11, wherein said heating step is conducted at a temperature of between approximately 150° C. and 300° C.

14. The process according to claim 11, wherein said heating step is conducted at a temperature of between approximately 200° C. and 250° C.

15. The process according to claim 11, wherein said heating step is conducted at a temperature of approximately 200° C.

16. The process according to claim 11, wherein said heating step is conducted for a period of time of between approximately 1 minute and approximately 20 minutes.

17. The process according to claim 11, wherein said hearing step is conducted for a period of time of between approximately 5 minutes and approximately 10 minutes.

18. The process according to claim 11, wherein said silver dodecylmercaptide is set in direct contact with said metallic aluminium.

19. The process according to claim 11, wherein said aluminium capsule contains within it said silver dodecyl-mercaptide in powder in pressed form.

20. The process according to claim 11, wherein said aluminium capsule is closed.

* * * * *